US007521849B2

(12) United States Patent
Havard et al.

(10) Patent No.: US 7,521,849 B2
(45) Date of Patent: Apr. 21, 2009

(54) SPARK PLUG WITH WELDED SLEEVE ON ELECTRODE

(75) Inventors: Karina Havard, Toledo, OH (US); Robert Freeman, Monclova, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 212 days.

(21) Appl. No.: 11/534,718

(22) Filed: Sep. 25, 2006

(65) Prior Publication Data

US 2007/0069618 A1 Mar. 29, 2007

Related U.S. Application Data

(60) Provisional application No. 60/721,821, filed on Sep. 29, 2005.

(51) Int. Cl.
*H01T 13/20* (2006.01)

(52) U.S. Cl. ..... 313/139; 313/118; 313/144

(58) Field of Classification Search ..... 313/139, 313/118, 144

See application file for complete search history.

(56) References Cited

U.S. PATENT DOCUMENTS

| | | | | |
|---|---|---|---|---|
| 1,313,040 | A | 8/1919 | Alexander | |
| 4,904,216 | A | 2/1990 | Kagawa et al. | |
| 5,101,135 | A * | 3/1992 | Oshima | 313/142 |
| 5,107,168 | A | 4/1992 | Friedrich et al. | |
| 5,280,214 | A | 1/1994 | Johnson | |
| 5,347,193 | A | 9/1994 | Oshima et al. | |
| 5,369,328 | A | 11/1994 | Gruber et al. | |
| 5,408,961 | A | 4/1995 | Smith | |
| 5,430,346 | A | 7/1995 | Johnson | |
| 5,502,351 | A | 3/1996 | Katoh et al. | |
| 5,557,158 | A | 9/1996 | Kanao et al. | |
| 5,697,334 | A | 12/1997 | Below | |
| 5,918,571 | A | 7/1999 | Below | |
| 6,064,144 | A * | 5/2000 | Knoll et al. | 313/141 |
| 6,080,029 | A | 6/2000 | Johnson et al. | |
| 6,676,468 | B2 | 1/2004 | Ishiguro et al. | |
| 6,705,009 | B2 | 3/2004 | Niessner | |
| 7,049,733 | B2 * | 5/2006 | Lykowski et al. | 313/141 |
| 2005/0093412 | A1 | 5/2005 | Lykowski et al. | |

(Continued)

FOREIGN PATENT DOCUMENTS

| | | |
|---|---|---|
| EP | 0 418 055 A1 | 3/1991 |

(Continued)

*Primary Examiner*—Peter Macchiarolo
(74) *Attorney, Agent, or Firm*—Robert L. Stearns; Dickinson Wright PLLC

(57) ABSTRACT

A spark plug assembly (22) includes a center electrode (34) having a high performance metal sleeve (50) attached at its sparking end. The sleeve (50) is fitted to a tenon on the end of the center electrode (34) and fixed in place by a weld line (58) produced by laser beam pulses (56). The weld line (58) is applied by overlapping a plurality of spaced-apart beads in a single, continuous circumscribing line. The sleeve (50) is permitted to expand and contract under the influence of thermal cycling without constraint except for the fixation weld line (58). Therefore, the sleeve (50) does not experience stress build-ups resulting from differing rates of thermal expansion relative to the center electrode (34), which is preferably made from a nickel or other composition dissimilar to that of the high performance metal sleeve (50). Various ground electrode (30, 60) configurations are possible.

15 Claims, 4 Drawing Sheets

U.S. PATENT DOCUMENTS

2006/0028106 A1* 2/2006 Lineton et al. ..... 313/139

FOREIGN PATENT DOCUMENTS

JP 55-126985 10/1980
JP 61-230282 10/1986
JP 06188063 A 7/1994
JP 06310256 A 11/1994

* cited by examiner

FIG - 1
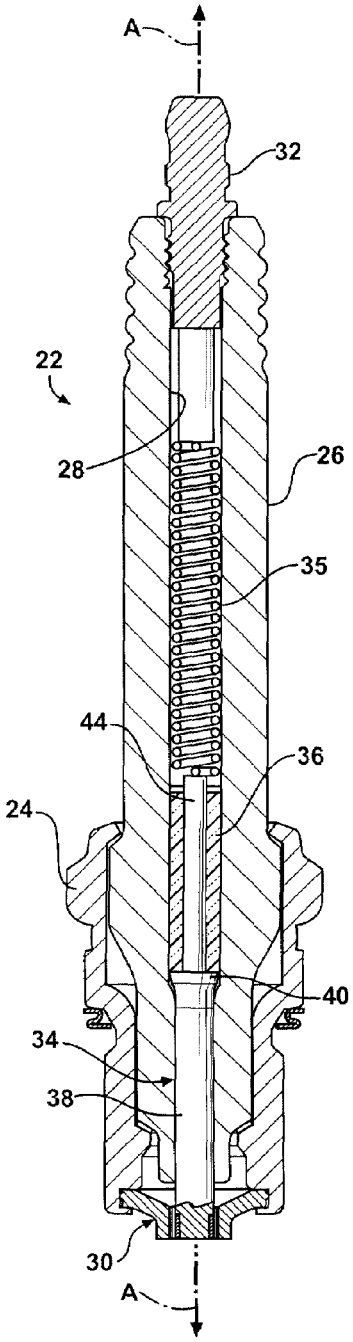
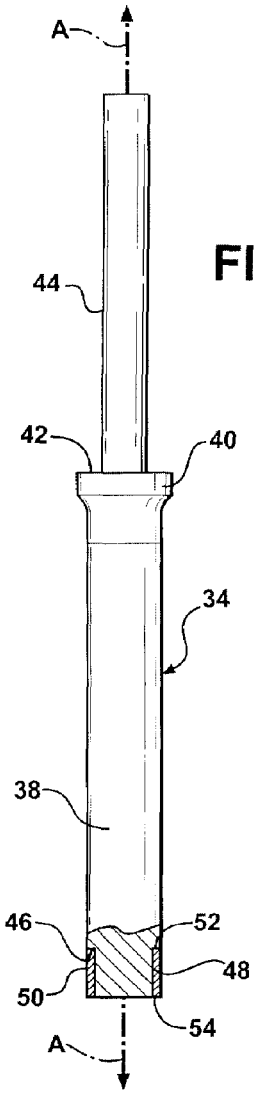
FIG - 2
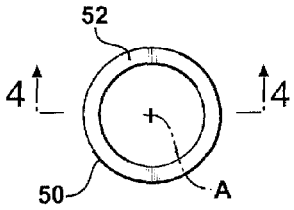
FIG - 3
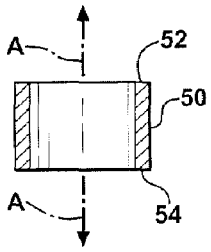
FIG - 4

FIG - 10
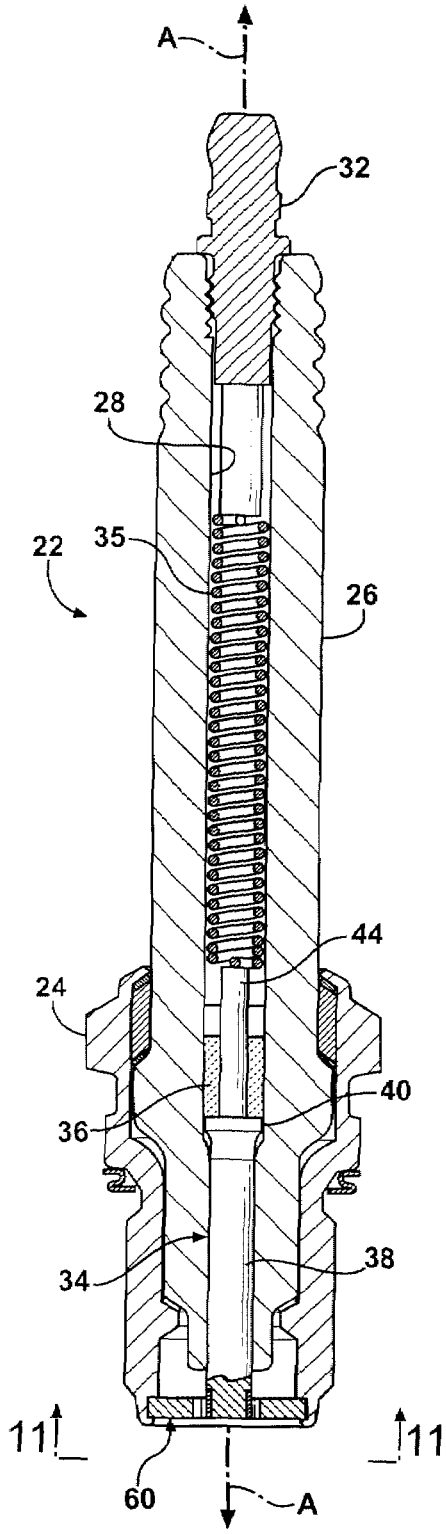
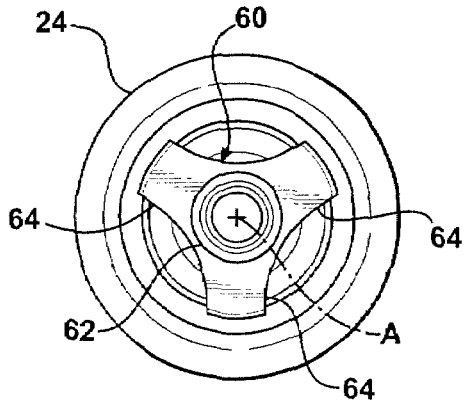
FIG - 11
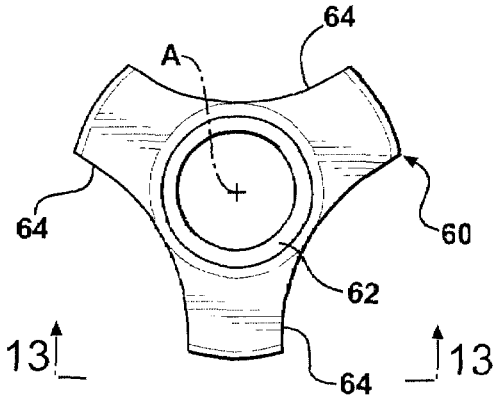
FIG - 12
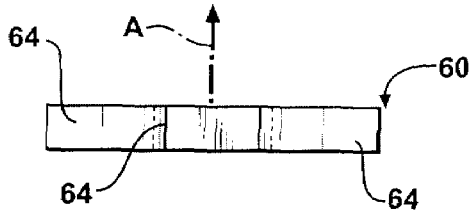
FIG - 13

SPARK PLUG WITH WELDED SLEEVE ON ELECTRODE

CROSS REFERENCE TO RELATED APPLICATIONS

The present application claims priority to U.S. provisional application entitled LASER WELD OF AN IRIDIUM SLEEVE ONTO CENTER ELECTRODE having Ser. No. 60/721,821 and filed on Sep. 29, 2005.

BACKGROUND OF THE INVENTION

1. Field of the Invention

The subject invention relates to a spark plug for an internal combustion engine, furnace, or the like wherein the spark plug includes at least one electrode having a wear-resistant sleeve welded thereto for enhanced durability and longevity.

2. Related Art

Within the field of spark plugs, there exists a continuing need to improve the erosion and corrosion resistance and reduce the sparking voltage needed to produce the spark in the gap between center and ground electrodes. To this end, various designs have been proposed using noble and/or precious metal firing tips applied to standard metal electrodes. Typically, the firing tip is pre-formed as a pad, rivet or wire which is later welded onto the end of either the center electrode, the ground electrode, or both.

Platinum and iridium alloys are two of the noble metals commonly used for these firing tips. Platinum-tungsten alloys have also been used, along with platinum-rhodium alloys and platinum-iridium-tungsten alloys. Other metals and/or alloys are also possible.

While these and various other noble metal systems typically provide acceptable spark plug performance, particularly with respect to controlling the spark performance and providing spark erosion and chemical corrosion protection, current spark plugs utilizing noble metal tips have well-known performance limitations associated with the relatively small sparking surfaces and with the methods which are used to attach the noble metal components, including various forms of welding. In particular, cyclic thermal stresses in the operating environment, such as those resulting from the mismatch in the thermal expansion coefficients between the electrode tip and the dissimilar base electrode, can decrease service life. Typically, the electrode tip will be fabricated from noble metals and the noble metal alloys mentioned above, whereas the base electrode will be made from nickel, nickel alloy, nickel clad copper, or other commonly used metal. The result of these mismatched thermal coefficients is cracking, thermal fatigue, and various other interaction phenomena that can result in the failure of the welds and, ultimately, of the spark plug itself.

The condition is particularly significant in the field of industrial power generation, wherein a spark plug may be operated for extended durations at a specified setting. In these types of applications, which are cited merely by way of example, it is desirable to very precisely tune the engine and its fuel supply, together with the ignition system, to obtain the highest possible efficiencies and fuel economies. Erosion and corrosion of the center and ground electrodes can have a profound effect on the efficiency and performance characteristics of such an engine. Accordingly, there is a great need in this field to provide a spark plug having improved erosion and corrosion resistance of the sparking surfaces and related components.

The prior art has long considered this situation and proposed numerous configurations within which to deploy noble metal components in the spark gap. For example, U.S. Pat. No. 4,904,216 to Kagawa discloses a spark plug having a center electrode fitted with a tubular precious metal sleeve that is attached by resistance welding and then afterward drawn and extruded to a final shape. In another example, U.S. Pat. No. 5,557,158 to Kanao et al., discloses a spark plug including a center electrode that is fitted with a tubular precious metal sleeve. The sleeve is captured on a tenon end and then fixed in position via a cap. In yet another example, U.S. Pat. No. 6,064,144 to Knoll et al., discloses a spark plug wherein a tubular sleeve is fitted to a tenon on the center electrode and retained in position by a compressing cinch. This is followed by a welding or soldering operation.

Accordingly, it is highly desirable to develop a spark plug having a noble metal firing tip in the form of a sleeve or other configuration applied to the sparking end of the center electrode. However, the prior art attempts have failed to account for potential failure mechanisms associated with the attachment of dissimilar materials to one another over a length, and which materials are subjected to intense thermal cycling. Accordingly, there is a need to develop methods of making spark plugs having improved structures so as to improve spark plug performance and reliability, while also sustaining component integrity in extremely harsh operating environments.

SUMMARY OF THE INVENTION

The subject invention comprises a spark plug assembly for a spark ignited engine, furnace, or the like. The assembly comprises a grounded metallic shell, including a ground electrode. An insulator body is disposed at least partially in the shell. The insulator body has an axial length and a central passage extending axially along its length. An electrically conductive center electrode is disposed in the central passage of the insulator body. The center electrode has an exposed length terminating in a distal tip. The center electrode is made from a first predetermined material composition. A sleeve is disposed about the exposed length of the center electrode and is fabricated from a second material, dissimilar to the first material. A fixation weld line is disposed in a single transverse plane, metallurgically joining the sleeve to the center electrode. As the center electrode and sleeve thermally expand and contract, they do so unencumbered relative to one another along their entire interface length except at the fixation weld. Therefore, differing rates of thermal expansion between the center electrode and the sleeve will not constrict the axial movements of either component. According to this invention, there is far less tendency for the center electrode to develop cracks or thermal fatiguing or other deleterious interaction phenomenon.

The invention also comprises a method for forming an electrode for a spark plug assembly as used in a spark ignited engine, furnace, or the like. The method comprises the steps of providing a center electrode having an axial length terminating in a distal tip. The method also includes forming a tenon on the center electrode adjacent the distal tip, the tenon having an inset shoulder and an axially extending cheek. A sleeve is provided having a base end and a free end. The method includes sliding the sleeve over the tenon and abutting the base end thereof with the shoulder of the tenon. A laser beam is provided. The method includes moving the laser beam in a relative path along the interface between the base end of the sleeve and the shoulder of the tenon to create a fixation weld line. The method further includes placing the center electrode into service, i.e., in a spark ignited engine, furnace, or the like, with only the fixation weld line joining the center electrode and sleeve so that the center electrode and sleeve are free to thermally expand and contract relative to one another along their entire interface length except at the fixation weld line.

Accordingly, the subject invention defines the novel assembly and method which overcomes the shortcomings and disadvantages inherent in the prior art designs. Specifically, the subject invention enables a spark plug to operate for extended periods without catastrophic failure due to the avoidance of cracking, thermal fatigue, or other deleterious interaction phenomenon between the center electrode and its high-performance sleeve component.

BRIEF DESCRIPTION OF THE DRAWINGS

These and other features and advantages of the present invention will become more readily appreciated when considered in connection with the following detailed description and appended drawings, wherein:

FIG. 1 is a cross-sectional view of a spark plug according to the subject invention including an exemplary four-prong ground electrode such as typically used in industrial engine applications;

FIG. 2 is a side elevation view in partial cross-section of the center electrode assembly;

FIG. 3 is an end view of the noble metal sleeve as fitted to the distal end of the center electrode;

FIG. 4 is a cross-sectional view taken generally along lines 4-4 of FIG. 3;

FIG. 10 is a cross-sectional view of a second embodiment of the invention, wherein an alternative annular ground electrode configuration is used instead of the 4-prong type illustrated in FIG. 1;

FIG. 11 is a bottom end view taken generally along lines 11-11 of FIG. 10;

FIG. 12 is an enlarged view of the alternative annular ground electrode; and FIG. 13 is a side elevation view as taken along lines 13-13 of FIG. 12.

DETAILED DESCRIPTION OF THE PREFERRED EMBODIMENT

Figure 5:
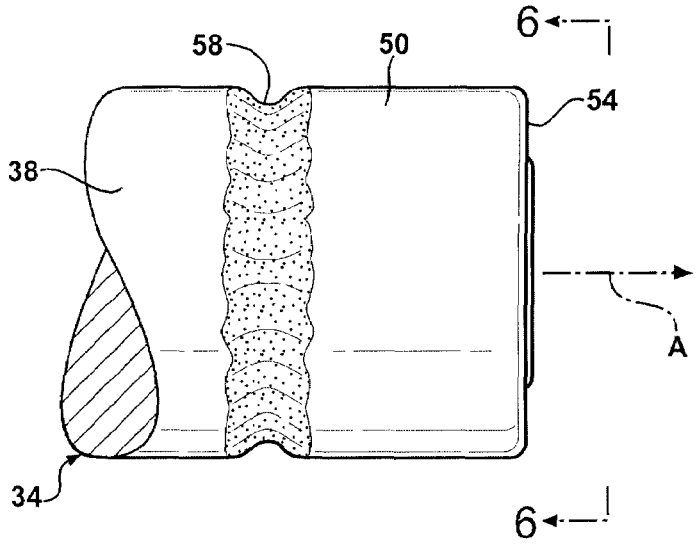
FIG. 5 is an enlarged view of the distal end region of the center electrode, including the sleeve welded thereto.
Figure 6:
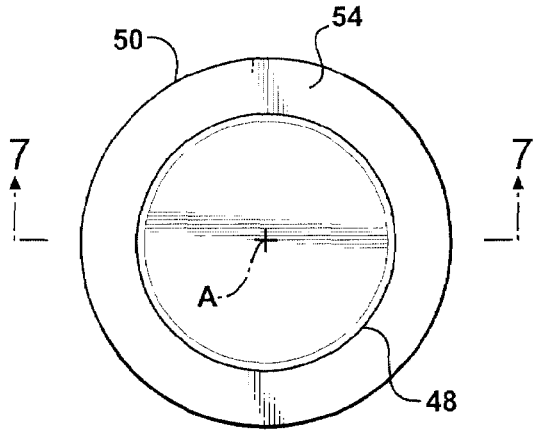
FIG. 6 is an end view of the center electrode assembly as shown in FIG. 5.
Figure 7:
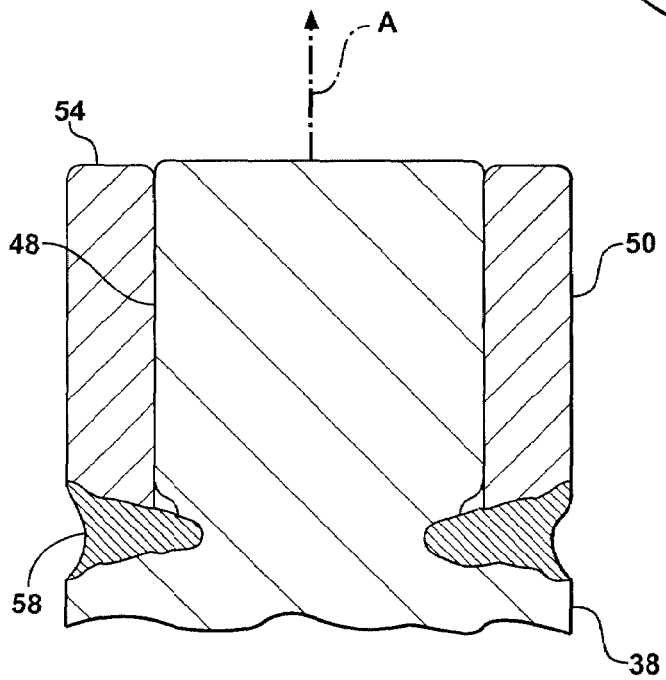
FIG. 7 is a cross-sectional view taken generally along lines 7-7 in FIG. 6 and depicting the weld zone penetration.

Referring to the figures, wherein like numerals indicate like or corresponding parts throughout the several views, a spark plug according to an exemplary embodiment of the subject invention is generally shown at 22 in FIG. 1. The spark plug 22 has a conductive metal shell 24 that is typically grounded upon attachment to an engine, furnace, or the like. A non-conductive insulator body 26 is disposed, at least partially, in the shell 24. The insulator body 26 has an axial length as defined by a longitudinally extending central axis A, which forms a vertical center line for the spark plug assembly 22. A central passage 28 extends axially through the insulator body 26 and is centered along the central axis A. An electrically conductive ground electrode 30 is connected to the shell 24, having a free end (or ends as the case may be) in the shape of arms or legs presented at a spark gap. In the embodiment of FIG. 1, ground electrode 30 is shown as the so-called 4-prong type, which is used chiefly in industrial engine applications. Alternatively, the traditional single ground wire style may be used, as well as any other type of ground configuration. For example, FIGS. 10-13 illustrate an alternative, full-annular type ground electrode as will be described in greater detail below.

The spark plug 22 further includes an upper terminal cap 32 fixed or otherwise retained in the central passage 28 at the top end of the spark plug 22. The opposite or lower end of the insulator body 26 is fitted with a center electrode assembly, generally indicated at 34. Interconnecting the upper terminal cap 32 and the center electrode assembly 34 is a conductive spring connector 35. Of course, this is but one exemplary embodiment of the conductive electrical components contained within the insulator body 26. Those of skill will appreciate other constructions and arrangements of components so as to achieve a suitable high voltage conducting feature contained within the insulator body 26. Returning to FIG. 1 in the embodiment as depicted, a glass seal 36 is provided between the center electrode 34 and the insulator 26 to prevent the escape of combustion gases. The glass seal 36 may be modified to include electrical noise suppression features or other attributes.

In FIG. 2, the center electrode assembly 34 is shown in greater detail, having a main body 38 which can be made from any material, but the preferred embodiment is made of nickel or a nickel alloy. A central flange 40 establishes an upper ledge 42 from which a reduced diameter upper post 44 extends. In this embodiment, the upper post 44 passes through the glass seal 36 and makes physical and electrical contact with the spring 35. The lower or distal end of the body 38 is machined or otherwise formed in the shape of a round tenon, establishing a shoulder 46 and a cheek 48. An optional undercut is shown at the intersection of the shoulder 46 and cheek 48. In an alternative configuration (not shown), the upper post 44 is omitted, and the glass seal 36 is replaced with a fired-in suppressor seal (FISS). An alternative FISS design may provide RFI suppression and form a conductive path between the spring 35 and center electrode assembly 34.

A tubular, cylindrical noble metal sleeve 50 is shown in detail in FIGS. 3 and 4. The sleeve 50 may be made from pure iridium, an iridium alloy containing rhodium and tungsten, or from other alloying elements. Alternatively, the sleeve 50 may be made from any other precious or noble metal, or alloys thereof, to provide high performance and high erosion and corrosion resistance throughout an extended service life. The inner diameter of the sleeve 50 is sized to allow either a clearance fit or slight interference fit onto the tenon cheek 48 when the internal diameter of the sleeve 50 is at the minimum of its dimensional tolerances and the tenon diameter is at the maximum of its dimensional tolerances.

Referring again to FIGS. 2 and 3, the sleeve 50 is shown including a generally consistent wall thickness extended between a base end 52 and free end 54. The base end 52 abuts the shoulder 46 of the tenon when installed on the end of the center electrode assembly 34. The undercut between the shoulder 46 and cheek 48, if used, will facilitate a good, tight fit of the base end 52 against the shoulder 46. The axial length of the sleeve 50 is generally equal to the axial length of the cheek 48 such that the free end 54 of the sleeve 50 is disposed in a common, generally transverse, plane with the distal tip of the center electrode 34. As perhaps best shown in FIG. 2, the main body 38 of the center electrode 34 has a major diameter which is generally equal to the major diameter of the sleeve 50. In practice, however, the wall thickness of the sleeve 50 may be sized slightly smaller than the radial width of the shoulder 46 so that a substantially continuous outer wall surface is presented by the body 38 of the center electrode 34 even in the event of a slight concentricity issue in either the sleeve 50 or the formed tenon. The slightly reduced wall thickness in the sleeve 50 thereby anticipates potential alignment issues so that insertion of the center electrode assembly 34 through the central passage 28 of the insulator body 26 is never challenged. In any event, the thickness of the sleeve 50 is optimized to have sufficient thickness to allow for the electrical erosion expected over the life of the spark plug 22, but to be thin enough to minimize internal stresses and costs. The sleeve 50 can be manufactured by machining from sheet or rod, or by growth on a carbon rod within an electroplating process, or by any other suitable technique.

Referring now to FIGS. 5-9, the method for attaching the sleeve 50 to the body 38 of the center electrode assembly 34 is shown. The sleeve 50 can be attached by any suitable welding operation after it has been placed over the cheek 48 of the tenon and brought into abutting relationship against the shoulder 46. Suitable welding techniques include, but are not limited to, laser welding, electron beam welding, and TIG welding, to name but a few.

Figure 9:
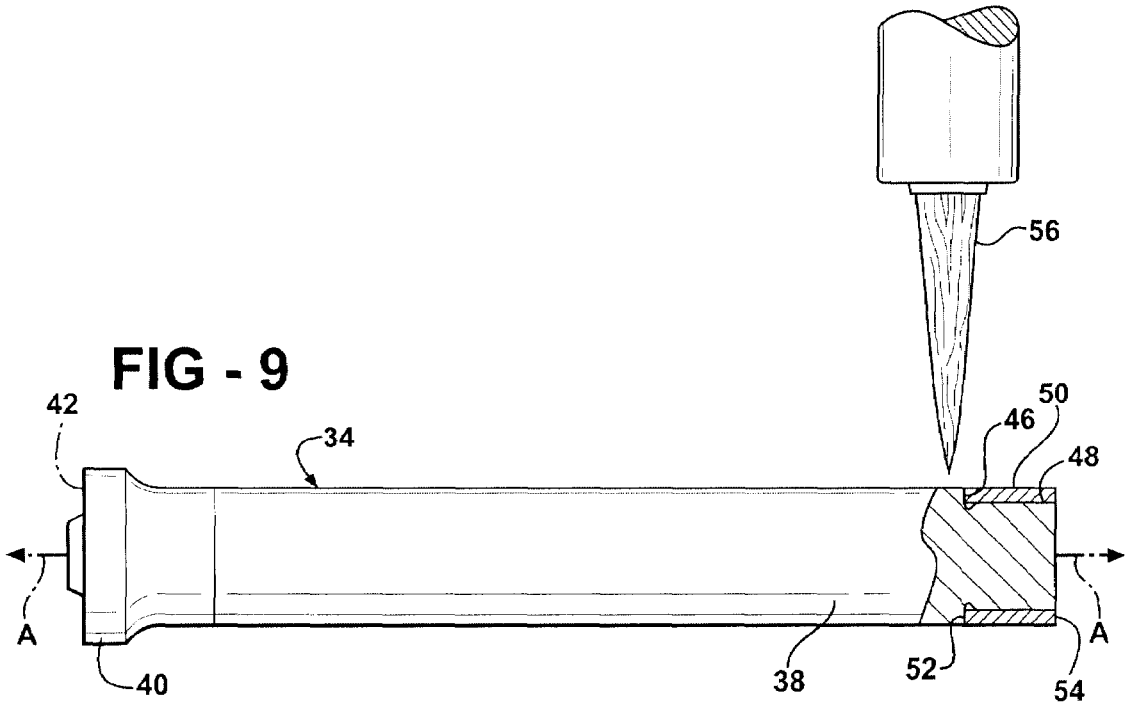
FIG. 9 depicts a laser welding set-up for attaching the sleeve to the distal tip of the center electrode so as to achieve a desirable weld formation.

The following specifications represent a single exemplary embodiment of the invention. Most or all of the specifications are subject to modification, given changes in equipment, materials, preferences, and other factors. Furthermore, these laser weld parameters have been optimized to increase the penetration and strength of the weld and to reduce splatter on the outside of the finished part. The angle of incidence of the laser beam 56 is nominally perpendicular to the electrode surface, as depicted in FIG. 9. The laser beam 56 may be directed 0.004 inches onto the body 38 below the interface between the sleeve 50 and the shoulder 46. In other words, the center line of the laser beam 56 is aimed 0.004 inches below the shoulder 46, although other displacements may prove preferable in some situations. Satisfactory results have been found using a laser weld process with the following parameters:

Weld energy: 1.6 Joules/pulse

Figure 8:
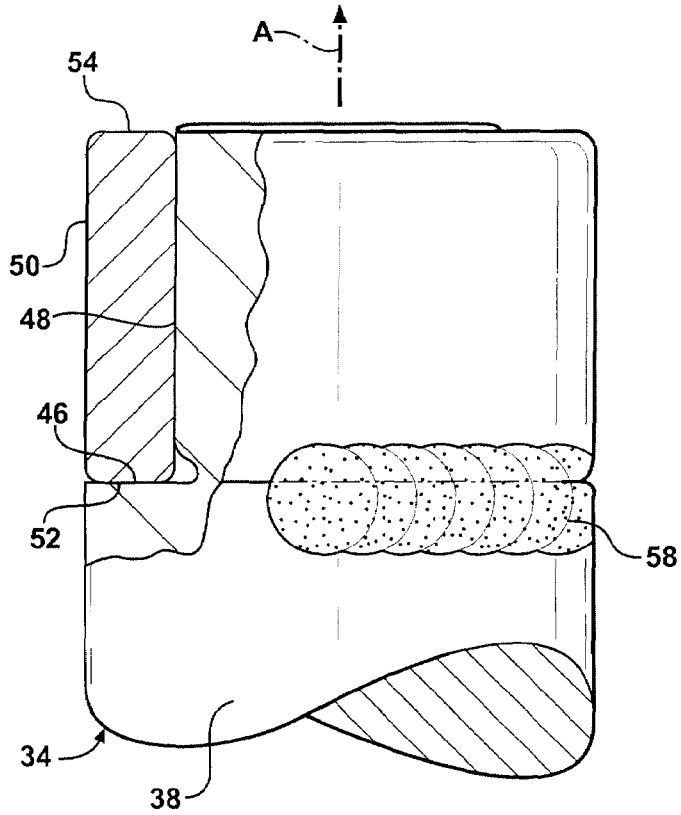
FIG. 8 is a fragmentary cross-sectional view demonstrating the weld formation in which successive, overlapping, and equally spaced beads are placed along the center line which may be set slightly below the sleeve/shoulder interface.

As accomplished, the directed beam of laser light 56 results in a single bead of overlapping weld spots targeted to fuse the sleeve 50 to the body 38, thereby forming a fixation weld line 58. The fixation weld line 58 in this configuration can be accomplished if the laser beam 56 is held stationary while the electrode body 38 is held vertically in a collet and rotated for one to four revolutions. Of course, the relative motion between the laser beam 56 and electrode body 38 can alternatively be accomplished by moving the laser while holding the electrode body 38 stationary, or perhaps moving both members at the same time. By following the parameters laid out above, a laser weld of numerous overlapping, regularly spaced beads with a weld bead diameter of approximately 0.02 inches and a weld spacing of approximately 0.008 inches or less can be achieved. This is depicted in FIG. 8.

Only the bottom of the sleeve 50 is welded, i.e., at its base end 52. The free end 54 of the sleeve 50 is not welded or otherwise affixed to the electrode assembly 34. This results in an accommodation for differing thermal expansion rates between the body 38 and the sleeve 50. Therefore, the sleeve 50 is not constricted in its axial direction otherwise than by the fixation weld line 58. In other words, welding at only one end of the sleeve 50 allows its high performance composition to thermally expand and contract at a different rate to the nickel or other dissimilar composition of the electrode assembly body 38 without building stresses within the sleeve 50. The completed center electrode assembly 34 is then used in one of various spark plug designs where the spark primarily propagates from the edge of the center electrode rather than from its tip, such as in the 4-prong configuration shown in FIG. 1 and the annular configuration shown in FIGS. 10-13.

In the embodiment shown in FIGS. 10-13, the ground electrode, generally indicated at 60, is fixed in the lower end of the shell 24 by first resistance welding into a pocket formed in the bottom of the shell 24, followed by a turnover operation to mechanically lock the ground electrode 60 in an inoperative position. The ground electrode 60 has a noble metal ring 62 that encircles the sleeve 50 on the center electrode 34 with a spark gap being formed in the annular space therebetween. The ring 62 is held in a centric position about the sleeve 50 in hub-like fashion by a frame composed of three spokes 64. Of course, more or fewer spokes 64 may be used and, indeed, it is even conceivable that in some applications, the frame might be fully annular with no discernable gaps or spokes.

Numerous methods of forming the ground electrode 60 are contemplated. In one embodiment, the spokes 64 are formed in a separate operation, such as by forging, machining, casting, or the like. Nickel would be a suitable material from which to manufacture the spokes 64. In like manner, the noble metal ring 62, which is preferably iridium, can also be separately manufactured, and the two components joined in a later operation, such as by laser welding. However, another possible technique for manufacturing the ground electrode 60 is available. According to this alternative technique, a carbon rod (not shown) is placed in an electro-deposition tank containing an iridium rich (or other noble metal or alloy) bath or an iridium anode. An appropriate electrical differential is established between the carbon rod and the bath (or anode), such that elemental iridium (or other noble metal or alloy) is attached to and evenly deposited about the exterior of the carbon rod to form an iridium shell. Once the iridium shell has achieved sufficient thickness, the rod is removed from the bath and transferred to a new electro-deposition tank in which a nickel rich bath or nickel anode is contained. Again, an electrical potential is established between the rod and the bath (or anode), such that elemental nickel (or other chosen metal) deposits itself about the exterior of the iridium shell, forming a nickel shell. Once the nickel shell has achieved an appropriate thickness, it is removed, cleaned, and machined. Finish operations can include forming scallops along the length of the nickel shell. A slicing operation will then yield individual wafers which eventually are transformed into the ground electrode 60. At an appropriate stage along the processes, the carbon rod can be removed.

The purpose for using the sleeve 50 and 62 on the center and ground electrode assembly 34 and 64 is to increase the life of these electrode assemblies, and thus the overall life of the spark plug 22. The disclosed electrode designs seek to maximize the ground electrode surface area while allowing good breathing of the spark gap, and to maintain a constant ground electrode gap with respect to the cylindrical surface of the center electrode 34. Therefore, if a continuous ring is not used for the ground electrode, the ground electrodes may be formed so as to have arcuate faces and thereby maintain a constant gap spacing across the entire spark gap.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A spark plug assembly for a spark ignited engine, said assembly comprising:

a grounded metallic shell, said shell including a ground electrode;

an insulator body disposed at least partially in said shell, said insulator body having an axial length and a central passage extending axially along said length;

an electrically conductive center electrode disposed in said central passage of said insulator body, said center electrode having an exposed length terminating in a distal tip, said center electrode having a first predetermined material composition;

a sleeve disposed about said exposed length of said center electrode, said sleeve being fabricated from a second predetermined material dissimilar to said first predetermined material of said center electrode, said sleeve having a base end and a free end; and a fixation weld line disposed in a single transverse plane and metallurgically joining said base end of said sleeve to said center electrode, said free end of said sleeve not metallurgically joined to said center electrode so that said sleeve is free to thermally expand and contract unencumbered along its length except at said fixation weld.

2. The assembly of claim 1, wherein said sleeve material is selected from a group consisting essentially of noble metals and alloys thereof.

3. The assembly of claim 1, wherein said center electrode includes a tenon formed on said exposed length thereof; said tenon including a generally transverse shoulder and a generally axial cheek.

4. The assembly of claim 3, wherein said cheek has a generally cylindrical shape, and said shoulder has a generally annular shape.

5. The assembly of claim 4, further including an undercut formation between said cheek of said tenon and said shoulder thereof.

6. The assembly of claim 4, wherein said sleeve has a generally cylindrical configuration adapted to slide over said cheek of said tenon and about said shoulder thereof.

7. The assembly of claim 6, wherein said fixation weld is disposed along an interface between said shoulder and said sleeve.

8. The assembly of claim 7, wherein said shoulder of said tenon includes a radial width, and wherein said fixation weld line penetrates radially into said center electrode a distance greater than said radial width of said shoulder.

9. The assembly of claim 7, wherein said exposed length of said center electrode has a major diameter, said sleeve having a major diameter generally equal to said major diameter of said exposed length of said center electrode.

10. The assembly of claim 7, wherein said sleeve has a base end adjacent said shoulder and a free end adjacent said distal tip of said center electrode, and wherein said sleeve has an axial length generally equal to the axial length of said cheek such that said free end of said sleeve is disposed in a generally common transverse plane with said distal tip of said center electrode.

11. A method for forming an electrode for a spark plug assembly used in a spark ignited engine, said method comprising the steps of:

providing a center electrode having an axial length terminating in a distal tip;

forming a tenon on the center electrode adjacent the distal tip, the tenon having an inset shoulder and an axially extending cheek;

providing a sleeve having a base end and a free end;

sliding the sleeve over the tenon and abutting the base end thereof with the shoulder of the tenon;

providing a laser beam;

moving the laser beam in a relative path along the interface between the base end of the sleeve and the shoulder of the tenon to create a fixation weld line; and placing the center electrode into service with only the fixation weld line at the base end metallurgically joining the center electrode to the sleeve so that the center electrode and sleeve are free to thermally expand and contract relative to one another along their entire interface length except at the fixation weld line at the base end.

12. The method of claim 11, wherein said step of moving the laser beam includes rotating the center electrode relative to the laser beam for greater than 360°.

13. The method of claim 11, wherein said step of providing a laser beam includes directing the laser beam generally perpendicular to the axis of the center electrode.

14. The method of claim 13, wherein said step of providing a laser beam includes directing the laser beam onto the center electrode below the base end of the sleeve.

15. The method of claim 11, wherein the fixation weld line penetrates radially into the center electrode at distance greater than the radial width of the sleeve.

* * * * *